US005327955A

United States Patent [19]

Easwaran

[11] Patent Number: 5,327,955

[45] Date of Patent: Jul. 12, 1994

[54] PROCESS FOR COMBINED CASTING AND HEAT TREATMENT

[75] Inventor: Jay Easwaran, Portage, Mich.

[73] Assignee: The Board of Trustees of Western Michigan University, Kalamazoo, Mich.

[21] Appl. No.: 57,693

[22] Filed: May 4, 1993

[51] Int. Cl.[5] ..... B22C 9/04; B22D 27/04

[52] U.S. Cl. ..... 164/516; 164/34; 164/122

[58] Field of Search ..... 164/516, 517, 518, 519, 164/34, 35

[56] References Cited

U.S. PATENT DOCUMENTS 4,222,429 9/1980 Kemp ..... 164/34 X 5,203,398 4/1993 Easwaran ..... 164/34 X

FOREIGN PATENT DOCUMENTS 2148760A 6/1985 United Kingdom ..... 164/34

*Primary Examiner*—J. Reed Batten, Jr.

*Attorney, Agent, or Firm*—Flynn, Thiel, Boutell & Tanis

[57] ABSTRACT

A foamed pattern of a desired part is first formed. The pattern is then dipped into a ceramic slurry and the slurry dried in order to form a shell containing the foamed pattern. A heated bed of a particulate medium is formed around the ceramic shell which causes the pattern to evaporate and form a mold. A molten metal is then introduced into the mold and solidified while being held at an elevated temperature for a period of time to accomplish a desired heat treatment of the metal. With this method, the casting does not have to be subsequently heat treated in a separate operation. It can be removed as an as cast casting, having the desired microstructures.

12 Claims, No Drawings

PROCESS FOR COMBINED CASTING AND HEAT TREATMENT

BACKGROUND OF THE INVENTION (1) Technical Field

This invention relates to the formation of metal parts by the use of foam patterns which are consumed or evaporated during the casting of the metal followed by controlled heat treatment in a single reactor.

(2) Description of the Prior Art

The casting or molding of metals is an art that has been in existence for a very long time and yet, surprisingly, has not experienced very many changes with respect to the basic techniques or materials used in the process.

Most of the prior art casting processes such as green sand molding or permanent molding require subsequent heat treatment in a separate operation to achieve the desired microstructures.

A typical prior art process for making a casting is by the "lost foam" or "evaporative pattern casting" method. This method initially requires the formation of a foam pattern out of a consumable polymeric material.

This foam pattern is then dipped or coated with a ceramic slurry and placed in a bed of dry, loose, cool sand. The sand bed is thoroughly vibrated to compact the particles around the coated pattern. After the compaction is completed, molten metal is poured directly onto the polymeric pattern. The pattern gradually evaporates as it comes in contact with the molten metal. The products of evaporation, mostly gases, are vented into the dry sand bed, leaving behind a cavity for the molten metal to fill. As the evaporation, followed by filling by molten metal, is completed, an exact replica of the polymeric pattern is reproduced in metal.

This typical prior art process of "lost foam" casting has problems in that the formation of the ceramic shell is costly and time consuming. The porosity of the ceramic shell also has to be carefully controlled in order to allow the gases evolved during the evaporation of the polymeric pattern to exit through the shell. Another problem with this conventional process is that the polymeric pattern often decomposes into lustrous carbon and gases which become defect core impurities in the metal part. In order to address this problem, the density of the pattern has to be carefully regulated, which also involves the expenditure of additional time and monitary expense.

There also exists the possibility that the ceramic shell may warp or crack because of the introduction of the molten metal therein. This would necessitate the formation of a new ceramic shell which would entail additional expenditures of time and expense.

In another "lost foam" or "evaporative casting" process, an oven is used to burn out the polymeric foam pattern from the ceramic shell. This process also requires the polymeric foam pattern to be coated with a large number of coats of the ceramic material since the ceramic shell ultimately must support the molten metal, and the problems also arise of damaging the ceramic shell during its removal from the oven and the ceramic shell warping during the burning out of the foam pattern.

Another prior art process for making a casting is the "lost wax" or "investment casting process". The "lost wax" process entails the coating of a wax pattern with a ceramic slurry. The coated wax pattern is inserted into a steam autoclave to remove the pattern. The removal of the wax pattern weakens the ceramic shell so the ceramic shell must be heated at temperatures up to 2000° F., in order to strengthen it. Molten metal is then introduced into the ceramic shell in order to form a casting.

Due to the weakness of the ceramic shell, the subsequent handling of the shell in order to introduce the molten metal therein, and the need for the ceramic shell to have sufficient strength to contain the molten metal without external support, from 10–14 coats of the ceramic slurry are applied to the wax pattern. The application of the large number of ceramic coatings consume a great deal of time and money.

U.S. Pat. No. 3,572,417 discloses a method for casting or molding metals in a mold. The mold comprises a refractory inorganic oxide foam which has been formed by heating a filled organic foam at a temperature and time sufficient to substantially decompose an organic binder to a carbonaceous state, or, alternatively, to substantially consume the organic binder to form a refractory inorganic foam. This patent discloses the use of an oven to decompose the organic binder and to fuse or sinter the remaining inorganic components. However, the formation of the "green" mold is an extremely complicated process and the time and expense involved in heating the "green" mold to a temperature sufficient to decompose the organic binder and fuse the remaining inorganic components is unnecessarily high.

U.S. Pat. No. 4,115,504 discloses a method for casting vitreous materials using the lost wax process. In this patent, a pattern of the article to be cast is made using a substance which is vaporized during the casting. Wax, polystyrene and polyethylene are disclosed as being suitable materials for the pattern. The pattern can be coated with a thin layer of a mixture of graphite and a refractory powder and then embedded in a heat resistant silica compound to form a casting mold. The silica compound typically is moistened or contains a cohesive material, such as a resin, in order to insure that the portion of the sand mold adjacent to the surface of the cast articles dries thoroughly. A vitreous material having a viscosity of between 20 and 100 poises is introduced into the mold and decomposes the pattern. The article formed in the mold can be ceramified by fluidizing the sand by means of a hot stream of gas. It is to be noted that this reference deals with the formation of a vitreous article, not a metal article, and requires that the viscosity of the casting material be maintained in a certain range in order for the casting material not to pierce the mold.

U.S. Pat. No. 4,640,728 discloses a method of joining foam patterns which are used in evaporative casting processes. This patent discloses a method of assembling complex, consumable foam patterns for use in evaporative pattern metal casting but gives no particulars as to the evaporative pattern process per se.

U.S. Pat. No. 4,995,443 discloses a method for producing a cast metal object in which a heated particulate medium at a temperature of between 1500°–2000° F. is used to support a ceramic shell containing a consumable polymeric pattern. The heat from the heated particulate medium causes the polymeric pattern to decompose and vaporize and form a cavity in the ceramic shell into which molten metal may be introduced. The molten metal is then allowed to solidify and form the cast metal object. Due to the high temperature of the particulate medium in this method, problems arise with respect to the handling and disposal of the vapors from the decomposed pattern.

In the production of many cast articles of steels, cast irons and some nonferrous alloys, the casting is subsequently heat treated in a subsequent operation to achieve a desired microstructure. This subsequent heat treatment is very expensive in terms of energy consumption, time and handling costs.

It is an object of the present invention to provide a method for forming a cast metal article by an evaporative casting process which does not contain the drawbacks of the processes used in the prior art.

It is a still further object of the present invention to provide an evaporative casting process followed by controlled heat treatment in a single reactor in an economical manner.

It is a still further object of the present invention to provide a process in which wasteful energy consumption in transporting cast parts to a heat treatment shop and repeated handling is eliminated. And as a result, economical production is achieved.

SUMMARY OF THE INVENTION

These and other objects of the present invention are accomplished by providing an evaporative casting process which uses a heated particulate medium as a means for supporting the ceramic shell and decomposing the polymeric pattern contained in the ceramic shell. The particulate medium can be coated with a catalytically active material to aid in the control of fumes generated during the decomposition of the polymeric pattern.

The particulate medium serves as a means for support for the ceramic shell during the casting process and thereby enables the ceramic shell to be much thinner, i.e., comprise fewer ceramic layers, than is possible in the prior art processes. The particulate medium also provides support for the ceramic shell during the evaporation of the foam pattern. This reduces the possibility of the shell warping or cracking during the evaporation stage and the heat from the particulate medium hardens the shell. The complete decomposition of the polymeric pattern by the heated particulate medium also eliminates gaseous and lustrous carbon defects in the cast part because the polymeric pattern is completely removed from the casting shell before the metal is introduced therein.

The metal to be cast is heated to the required temperature while the polymeric pattern is being evaporated in the fluidized bed. The metal is then poured into the empty cavity which is held at a predetermined temperature, of typically from 800°-1650° F. As the metal is solidifying in the mold, the metal is held at a temperature for an amount of time necessary to accomplish the desired heat treatment. The casting can then be removed from the fluidized bed and the shell removed by a suitable method.

In this manner, the desired microstructure can be achieved.

It is also possible to subject the heat treated cast article with a normalizing, quenching or austempering step before or immediately after the ceramic shell is removed.

The cast metal articles can also be annealed while in the ceramic shell.

DETAILED DESCRIPTION

The evaporative casting process of the present invention requires an expendable or consumable foam replica or pattern of the part to be cast. Suitable materials of construction for the pattern are materials which will decompose at the temperature of the heated sand used in the present process. Preferred materials are polymeric compounds such as polystyrene, polymethyl methacrylate and polyalkyl carbonate with polystyrene and polymethyl methacrylate being especially preferred.

A consumable foam pattern may be prepared in a typical manner such as by introducing polystyrene or polymethyl methacrylate beads into an aluminum die and injecting steam into the die to fuse the polymeric material and form a pattern. With the present invention, the density of the consumable pattern is not critical. However, in order to avoid combustion problems during the vaporization of the pattern, when polystyrene is used as the material of construction for the consumable pattern, a preferred density of the pattern is about 1 $lb/ft_2$.

After the pattern is formed, it is assembled with the necessary gating, pouring cups, and sprues that will be necessary to introduce the molten metal into the evacuated ceramic shell.

This pattern assembly is then disposed on a hook and dipped in a tank of ceramic slurry comprising a fused silica refractory, a colloidal silica binder and water. The average particle size of the fused silica is not critical and may range from about 50 mesh to about 400 mesh. A preferred average particle size is between about 100 mesh and 300 mesh with an average particle size of about 200 mesh being especially preferred. The amount of colloidal silica binder present in the slurry is dependent on the particle size and amount of fused silica present. A desirable amount of colloidal silica is between 5-10% by weight based on the weight of the fused silica in the slurry. The ceramic slurry is preferably maintained at about 60 per cent solids but the temperature of the slurry is not critical and can be maintained at ambient temperatures. Although a specific type of ceramic slurry is described above, in the present invention, the term "ceramic" is intended to cover any suitable inorganic material.

After the pattern assembly is completely wetted by the ceramic slurry, it is removed from the slurry bath and placed in a fluidized bed of fused silica powder. The fused silica powder has a particle size of about −50 to +100 mesh and air or any other suitable fluidizing gas is used as the fluidizing medium. The pattern assembly is disposed in the fluidized bed of fused silica powder until it is completely coated with the powder. The ceramic slurry coating and the fused silica coating together constitute an initial ceramic shell layer. After the initial ceramic shell layer is formed on the pattern assembly, the assembly is removed from the fluidized bed of fused silica powder and the initial shell layer dried in air. The coating steps are repeated between 1-5 times to produce a strong enough final ceramic shell for the subsequent casting operations. The porosity of the final ceramic shell is not critical but desirably, the thickness of the final ceramic shell is approximately 6-25 mm. thick.

After the final ceramic shell is air dried, a bed of a dry particulate medium, which is typically heated to a temperature between 800°-1650° F. and contained in a suitable container for the process conditions is formed around the entire assembly. The material of construction of the container can be any glass, ceramic or metal that can withstand the process conditions and a preferred particulate medium is sand. The particulate medium preferably have a spherical or angular shape and a size distribution between −40 mesh to +200 mesh. The sand particles can be silica, alumina, zirconia or olivine and combinations thereof with olivine being preferred.

The particulate medium may additionally be coated with a catalytic material which aids in the pollution control of the gases of the vaporized pattern by suppressing the formation of elemental carbon. The amount of catalyst used with respect to the weight of the particulate medium is dependent on the amount and type of material used to make the pattern and the type of catalyst used. When platinum is used, a desirable weight percent is 0.01% with respect to the weight of the particulate medium. The platinum is deposited on the particulate medium by dipping it into a platinum containing solution, such as platinum chloride, and then drying the coated particulate medium.

The bed of heated particulate medium can be formed around the ceramic shell containing the polymeric mold by pouring the heated particulate medium around the ceramic shell, introducing the ceramic shell into a fluidized bed of a heated particulate medium and compacting the fluidized bed around the ceramic shell, or inserting the ceramic shell into a quiescent bed of the heated particulate medium. A preferred method of forming the bed of heated particulate medium around the ceramic shell is to insert the ceramic shell into a fluidized bed of a heated particulate medium and compact the fluidized bed around the ceramic shell.

When the pattern assembly is completely covered by the heated particulate medium, the level of the particulate medium should be just sufficient to be flush with the top of the pouring cup.

The pattern assembly is rapidly heated to a high temperature by the hot particulate medium and the consumable pattern vaporized therefrom. In order to avoid pollution problems, the consumable pattern is preferably vaporized in an inert atmosphere such as a nitrogen-/argon atmosphere. These gases can also be used as the fluidizing medium for the particulate medium.

When the decomposition of the pattern is carried out in an ambient atmosphere, dark smoke will be produced from the combustion of the consumable pattern. This smoke will be comprised of various hydrocarbons and gaseous carbon. This smoke should be captured and incinerated to maintain healthy working conditions. The use of a particulate medium coated with a catalytically active material aids in the control of the liberated gases by reducing the amount of gaseous carbon generated.

Once the entire consumable pattern is evaporated by the heated particulate medium from the ceramic shell to form a mold, molten metal is introduced into the empty cavity by way of the pouring cup and is held at a high temperature. The solidifying metal is held at a temperature usually from 800°-1650° F., for an amount of time necessary to accomplish the desired heat treatment of the metal, typically from 10-15 minutes, before the casting is removed. The particulate medium provides support for the mold during the pouring of the molten metal, allows the mold to be supported without movement, and reduces the possibility of the ceramic shell cracking or warping during the introduction of the molten metal.

After the cast metal has been held at the desired temperature for the desired amount of time, it can be removed from the mold as an as cast metal part.

This process allows a foundry to eliminate wasteful energy consumption in transporting cast parts to a heat treatment shop. It also eliminates repeated handling and speeds up the entire process resulting in economical production of components.

The following examples will serve to illustrate the present invention.

EXAMPLE 1

A polystyrene pattern of a shaft was prepared by molding expanded polystyrene beads in an injection molding machine equipped with a steam chest. The shaft was approximately 3.5 inches in diameter at its maximum and 1.5 inches in diameter at its minimum and 23.5 inches long. Gates and risers, also made of polystyrene, were attached at the appropriate locations along the pattern. This assembly was then dipped in a two part ceramic slurry in sequence and dried. After a sufficient number of coats were applied and dried the assembly was lowered into a hot fluidized bed of ceramic particles. The bed temperature was maintained at 1600° F. After the assembly was properly located in the fluidized bed, the air supply for fluidization was turned off. The polystyrene pattern was gradually evaporated leaving behind a clean empty shell.

While the pattern was being evaporated in the fluidized bed, scrap steel and ferroalloys were added to an induction melting furnace. This charge was melted and analyzed to conform nominally to AISI 1030 steel. The metal melted was held at a temperature of 3100° F. when a small amount of aluminum was added to kill the steel and it was tapped into a pouring ladle. The ladle was carried to the fluidized bed and the metal was poured into the empty cavity which was held at 1600° F.

The solidifying steel was held at 1600° F. for 15 minutes and the casting was removed from the fluidized bed and taken to a blasting cabinet where the shell was removed by shot blasting. The exposed casting was allowed to cool in air.

The casting was sectioned at its thickest and thinnest sections and examined microscopically after proper metallurgical surface preparation. The structure revealed was free of the blocky ferritic areas characteristic of steel castings of this composition. Tensile tests were also conducted from samples cut from the thinnest and thickest sections. The results from these tests were as follows:

| | Thin | Thick |
|---|---|---|
| Ultimate Tensile Strength | 78 KSI | 67.5 KSI |
| Yield Strength | 44 KSI | 36.2 KSI |
| Elongation | 18 pCT | 26 PCT |

The metallographic and tensile results are indicative of fully normalized structure. This microstructure was achieved without a special heat treatment after the casting.

EXAMPLE 2

The procedure used in this example was the same as for the previous example except that the casting was held in the fluidized bed for 15 minutes at 1650° F. It was removed from the fluidized bed and immediately subjected to cleaning in a water jet cleaning system. The water temperature was maintained at 75° F. The water jet cleaning system performs dual functions: it removes the ceramic coating and while doing so, quenches the steel.

The quenched steel was sectioned, polished and etched at the thickest and thinnest sections. Both sections were completely converted to a martensitic microstructure.

EXAMPLE 3

In this example, the pattern was prepared as before, but the fluidized bed was maintained at a temperature of 1000° F. during the removal of the polystyrene foam pattern.

The charge to the induction furnace was prepared to yield a base ductile iron of the following composition:

| | |
|---|---|
| Carbon | 3.72% |
| Silicon | 1.60% |
| Manganese | 0.06% |
| Sulfur | 0.014% |
| Phosphorus | 0.036% |
| Molybdenum | 0.55% |
| Nickel | 1.10% |

The base iron was tapped into a treatment ladle at 2850° F. and treated with magnesium ferrosilicon which converted the base iron to ductile iron. This iron was then transferred to a pouring ladle. While the transfer was being conducted 75% ferrosilicon was added to the stream to post inoculate the treated ductile iron. After slag was removed, the metal was poured into the empty cavity in the fluidized bed which was maintained at 1000° F.

The casting was allowed to remain in the fluidized bed for 10 minutes and then air cooled prior to blasting to remove the ceramic shell. The casting was examined microscopically at the thin and thick sections. The examination revealed the typical acicular structure characteristic of bainite. In other words, the cast material is rapidly converted to the desired bainitic microstructure and can be removed as an as cast bainitic ductile iron.

EXAMPLE 4

An aluminum alloy with the aluminum association designation 296.0 was used in this example. This alloy contains 4.5 percent copper and forms a precipitation hardening system.

While the alloy was being melted, a pattern of a brake calliper was prepared as before and placed in the fluidized bed at a temperature of 900° F. The molten aluminum alloy was poured into the empty cavity in the fluidized bed as before after proper degassing to remove unwanted gases.

The frozen casting was held in the fluidized bed for approximately 10 minutes and was immediately transferred to a water jet cleaning system where the ceramic coating was removed while the underlying casting was quenched.

Tensile bars were made from the casting. One tensile bar was tested in the as quenched condition and another was tested after aging at 250° F. for 48 hours. The results were as follows:

| | Solution Treated | Aged |
|---|---|---|
| Ultimate Tensile Strength | 32.2 KSI | 42.1 KSI |
| Yield Strength | 17.4 KSI | 23.8 KSI |
| Elongation | 8% | 6% |

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A method of producing a cast metal part comprising the steps of forming a pattern for a metal part out of a heat-vaporizable material; forming a ceramic shell around said pattern; forming a bed of a heated particulate medium around said ceramic shell; vaporizing the pattern to form a mold; introducing molten metal into said mold; holding said bed at an elevated temperature for an amount of time necessary to form desired microstructures while solidifying the molten metal; and removing said solidified molten metal from said mold as a cast metal part having the desired microstructures.

2. The method of claim 1, wherein during the holding step, the bed is held at an elevated temperature of 1600° F. for 15 minutes to yield said cast metal part having a normalized microstructure.

3. The method of claim 2, wherein the mold is removed by shot blasting.

4. The method of claim 2, further comprising cooling the cast metal part in air.

5. The method of claim 1, wherein during the holding step, the bed is held at an elevated temperature of 1650° F. for 15 minutes, and then the solidified molten metal is removed from the mold with water from a water jet cleaning system thereby quenching said metal and yielding matensitic microstructures in the cast metal part.

6. The method of claim 5, wherein the water from the water jet cleaning system is maintained at 75° F.

7. The method of claim 1, wherein during the step of vaporizing the pattern to form a mold, the bed is maintained at a temperature of 1000° F.

8. The method of claim 7 wherein during the holding step, the bed is held at an elevated temperature of 1000° F for 10 minutes and the solidified molten metal subsequently air cooled before removing the solidified metal from the mold to form said cast metal part having bainitic microstructure.

9. A method of producing a cast metal part comprising the steps of forming a pattern for a metal part out of a heat vaporizable material; forming a ceramic shell around said pattern; forming a bed of heated particulate medium around said ceramic shell; vaporizing the pattern to form a mold; introducing molten metal into said mold; holding said bed at an elevated temperature of 1000°-1650° F. for 10-15 minutes while solidifying the molten metal; and removing said solidified metal from said mold to form a cast metal part having desired microstructures.

10. The method of claim 9, wherein the bed is held at 1600° F. for 15 minutes and further comprising cooling the cast metal part in air after removing the mold to yield normalized microstructures.

11. The method of claim 9, wherein the bed is held at 1650° F. for 15 minutes and the solidified metal is removed from the mold with a water jet cleaning system, thereby quenching the metal and yielding matensitic microstructures.

12. The method of claim 9, wherein during the vaporizing step, the bed is maintained at a temperature of 1000° F., wherein during the holding step, the bed is held at an elevated temperature of 1000° F. for 10 minutes and subsequently air cooling the solidified metal before removing the solidified metal from the mold to form said cast metal part having bainitic microstructures.

* * * * *

UNITED STATES PATENT AND TRADEMARK OFFICE

CERTIFICATE OF CORRECTION

PATENT NO. : 5,327,955

DATED : July 12, 1994

INVENTOR(S) : Jay EASWARAN

It is certified that error appears in the above-indentified patent and that said Letters Patent is hereby corrected as shown below:

Column 8, line 26; delete "molten".
line 38; delete "molten".
line 50; delete "molten".

Signed and Sealed this

Eleventh Day of October, 1994

*Attest:*

Bruce Lehman

BRUCE LEHMAN

*Attesting Officer*

*Commissioner of Patents and Trademarks*